United States Patent [19]

Crumley

[11] 4,126,308

[45] Nov. 21, 1978

[54] COMBINATION POMMEL HORSE AND ROTATABLE WHEEL MOUNTED LEG SUPPORT DEVICE

[76] Inventor: Jesse C. Crumley, 3N305 Cardinal St., Addison, Ill. 60101

[21] Appl. No.: 689,855

[22] Filed: May 25, 1976

[51] Int. Cl.[2] ..... A63B 5/12; A63B 69/00

[52] U.S. Cl. ..... 272/64

[58] Field of Search ..... 272/64, 63, 62, 109, 272/111, 145, 146, 132, 72, 119, 96; 128/25 R, 25 B

[56] References Cited

U.S. PATENT DOCUMENTS

| | | | |
|---|---|---|---|
| 1,511,312 | 10/1924 | Alastalo | 272/119 |
| 2,250,493 | 7/1941 | Milne | 272/96 |
| 2,666,640 | 1/1954 | Jennings | 272/63 |
| 2,706,632 | 4/1955 | Chandler | 272/109 X |
| 2,921,791 | 1/1960 | Berne | 272/132 |
| 3,100,639 | 8/1963 | Bonewitz | 272/146 |
| 3,379,439 | 4/1968 | Sorenson et al. | 272/64 |
| 3,758,110 | 7/1973 | Fenner et al. | 272/64 |
| 3,767,191 | 10/1973 | Riley | 272/64 |
| 3,857,563 | 12/1974 | Azara | 272/109 X |
| 3,904,196 | 7/1975 | Berlin | 272/72 |

*Primary Examiner*—Richard C. Pinkham
*Assistant Examiner*—William R. Browne
*Attorney, Agent, or Firm*—Hill, Gross, Simpson, Van Santen, Steadman, Chiara & Simpson

[57] ABSTRACT

An athletic training and exercising device, particularly for developing and training the body in connection with gymnastics and exercise on the pommel horse. The invention utilizes a pair of simulated pommels in combination with a supporting structure, mounted on wheels, and having an endless belt upon which the user's legs may be supported, whereby the general movements of the body with respect to the normal pommel horse may be simultated without any danger to the user and at the same time giving substantially complete freedom of flexibility and movement of the user's legs, with complete safety and reliability.

11 Claims, 6 Drawing Figures

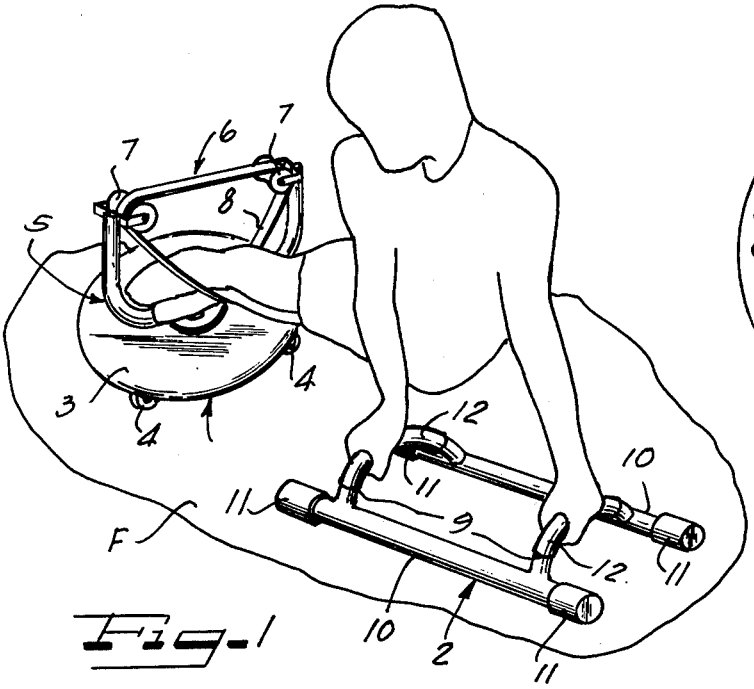
Fig-1
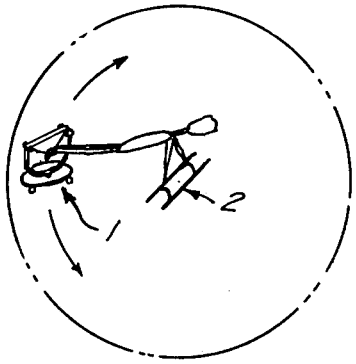
Fig-2
Fig-3
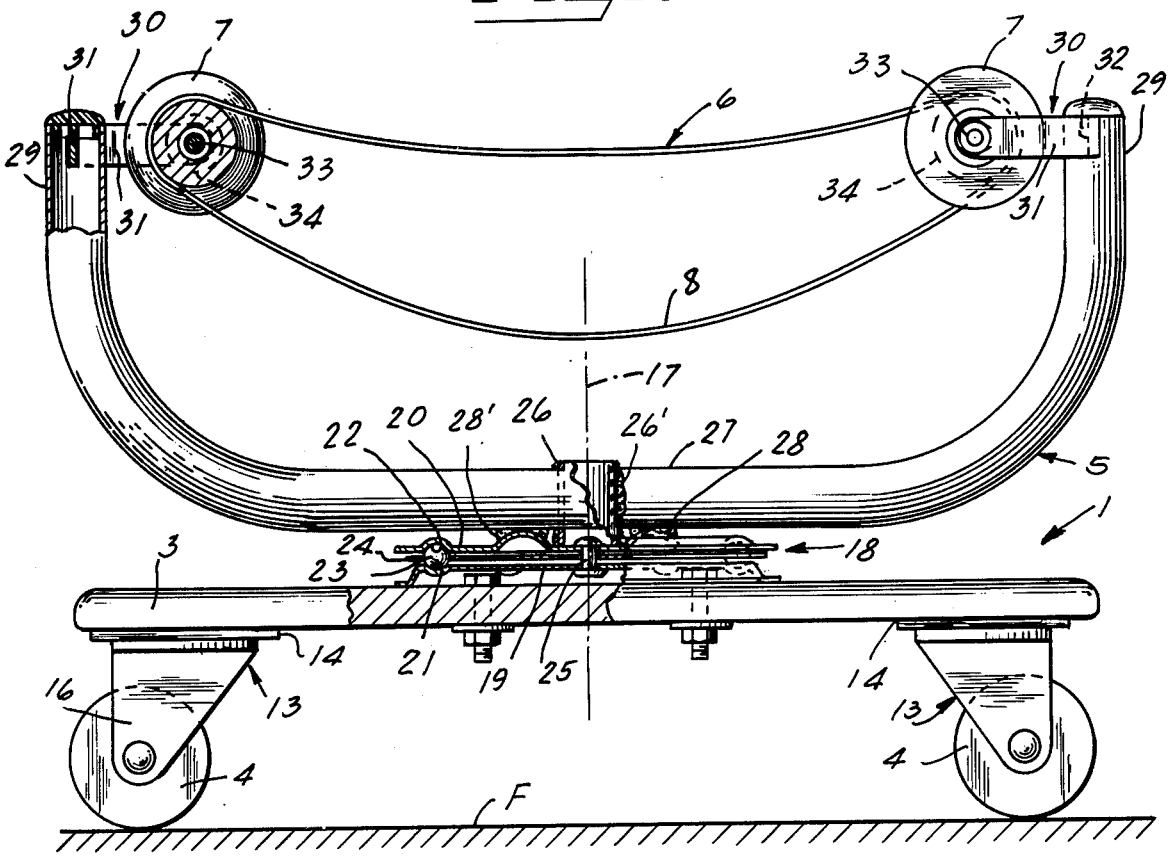

Fig-4
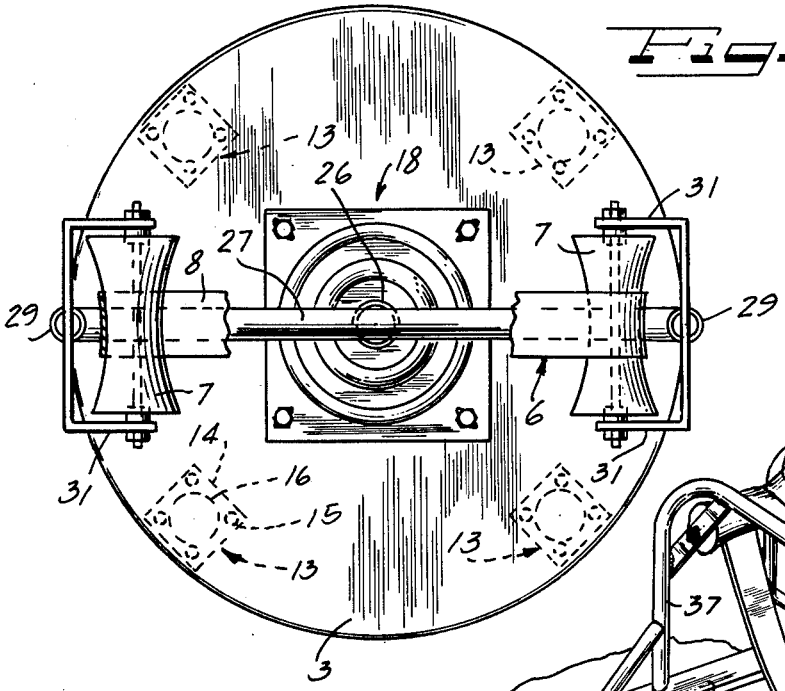
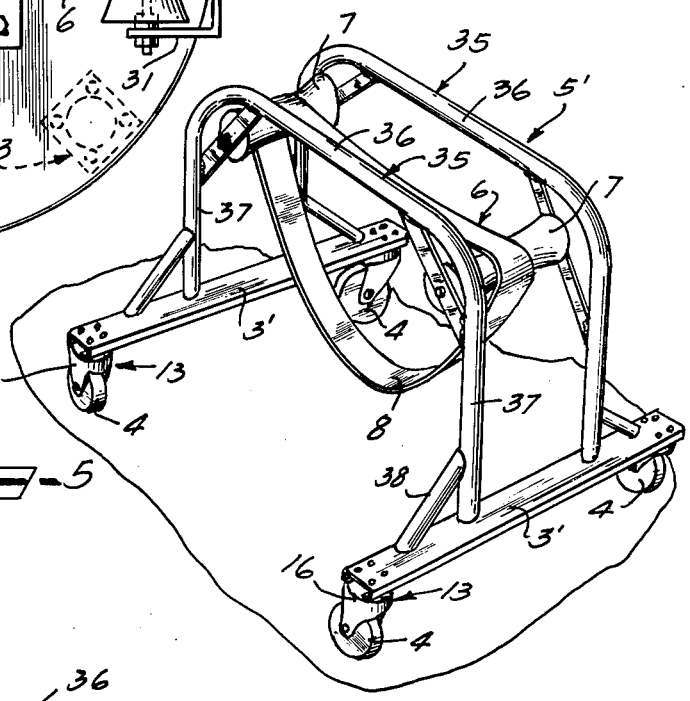
Fig-5
Fig-6
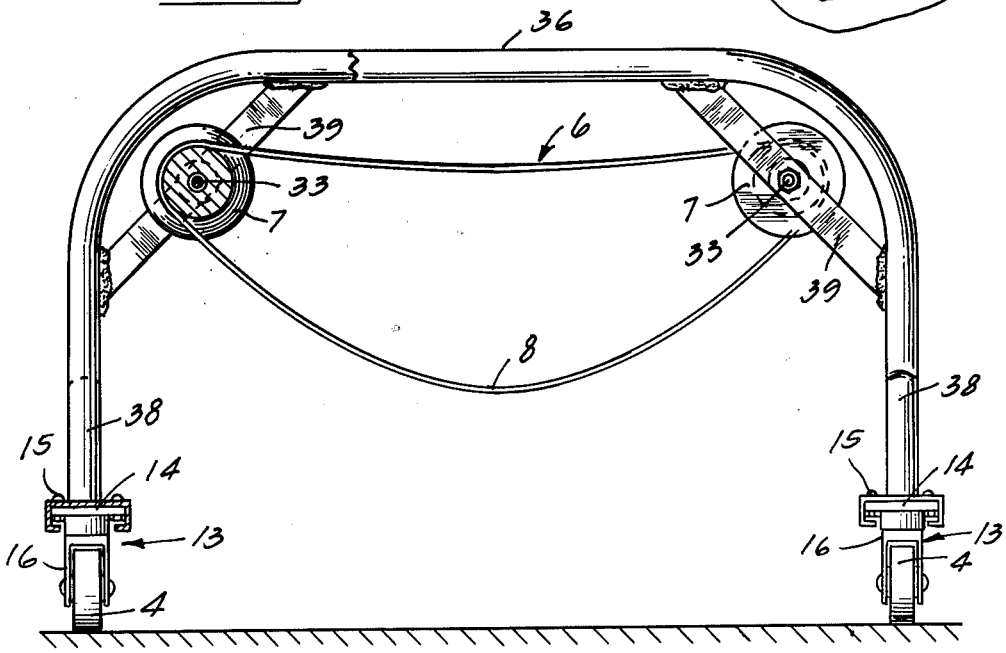

COMBINATION POMMEL HORSE AND ROTATABLE WHEEL MOUNTED LEG SUPPORT DEVICE

BACKGROUND OF THE INVENTION

With the increasing prominence of athletics, and in particular gymnastics, efforts have been made in many fields of sport to provide devices for simulating the body movements associated with various types of exercise and gymnastics, etc.

One of the more difficult gymnastic routines is that in connection with the pommel horse, which due to its nature, i.e. the elevated horse carrying two-hand pommels at a height of between three and four feet above the floor with the user grasping a pommel in each hand and swinging the body over the horse with various gymnastic routines, is difficult for a novice, particularly initially, to master the elementary body movements, particularly unaided, and it is quite common in such cases to initially manually support the user's body through the basic movements. Likewise, until the user is reasonably adept there is always the danger of possible injury.

BRIEF SUMMARY OF THE INVENTION

The present invention is directed to a training device in which the user can quite accurately simulate the body movements required on the pommel horse, without assistance and without danger of injury if improperly performed. This is accomplished by positioning the user in a generally prone position a matter of inches above a floor surface, with the body being supported by a pair of pommels adapted to be positioned just above the floor surface, and with the user's feet also suspended above the floor surface but unrestricted as to movement over the floor surface and as to twisting movement of the body. This is accomplished by a leg-supporting structure having a leg-supportable element adapted to engage the user's legs at the ankles and, while providing support therefor, permits free pivotal movement of the body and the legs so supported. At the same time the device is supported by casters or the like whereby it may freely move in any direction on the floor surface, with the leg supportable member being pivotally mounted on the caster supported structure whereby maximum freedom of movement in any direction is achieved.

In operation, the user supports the body by means of the arms with the hands gripping the pommel, in a generally face-downward, prone position, and the legs supported at the ankles in the leg-supporting structure.

Preferably, the ankles are supported by a portion of an endless belt which is suspended between two-spaced rollers whereby the support supplied by the belt will not offer any material resistance to a twisting of the user's body and legs as the supporting belt is free to move laterally with the twisting movement and thus offering no resistance to the same.

Under such conditions, the user is free to swing his body and legs in an arc, more or less pivoting from his grip on the pommels to quite closely simulate the body movements when swinging over a pommel horse. However, there is no danger of the user losing his balance and falling or otherwise injuring himself. The user thus can begin his initial training with the device to produce both body development as well as a knowledge of the movements, and confidence in execution thereof. At the same time the device is an excellent exerciser for use in muscular development, particularly in connection with pommel horse exercises and routines.

BRIEF DESCRIPTION OF THE DRAWINGS

In the drawings wherein like reference characters indicate like or corresponding parts:

FIG. 1 is a perspective view of the device of the present invention, illustrating the general body position when in use;

FIG. 2 is a schematic view illustrating the manner in which the device may be used;

FIG. 3 is a side elevation, with portions broken away, of the leg-supporting device of the invention;

FIG. 4 is a top plan view of the structure illustrated in FIG. 3;

FIG. 5 is a perspective view of a modified form of the invention; and

FIG. 6 is a side elevation of the embodiment illustrated in FIG. 5, with portions thereof broken away to show details thereof.

DETAILED DESCRIPTION OF THE INVENTION

General

Referring to FIGS. 1 and 2, the training and exercising device comprises two separate members, the first being a leg-supporting structure, indicated generally by the numeral 1, and a pommel structure, indicated generally by the numeral 2.

In the embodiment of the invention illustrated in FIG. 1, the leg-supporting structure 1 comprises three principal components, the first being a base structure 3, illustrated as being generally circular in configuration and having a plurality of supporting wheels 4, which preferably are in the form of casters, enabling the base 3 to freely move in any direction over the floor surface. Supported from the base member 3 for pivotal movement about a vertical axis is a cradle-shaped member, indicated generally by the numeral 5, of generally U-shaped configuration, constructed from tubular metal stock and adapted to support an endless loop 6 of suitable material, as for example, suitable webbing or the like, with the belt 6 passing over freely rotatable supporting rollers 7 carried by the free upper ends of the U-shaped member 5 with the belt 6 being of a length to enable the lower or bottom portion 8 forming a cradle adapted to receive and support the user's legs as illustrated in FIG. 1.

The pommel structure 2 comprises a pair of arcuate-shaped pommels or handles 9, each of which is generally circular in transverse cross-section and arcuate in configuration, with the two pommels being disposed in spaced substantially vertical parallel planes. Corresponding ends of the respective pommels are secured to spaced parallel tubular members 10, with the free ends of the members being provided with caps 11, of suitable rubber or plastic material, which will firmly grip the floor surface and remain stationary thereon throughout the use of the device. The pommel structure may be constructed of any suitable material as, for example, tubular metal, and the pommels 9 may be provided with gripping members 12 of suitable material as, for example, rubber or plastic which will provide a good non-slip hand-gripping surface.

Briefly, in use the user assumes a generally prone position with the legs supported in the belt 8 and the upper part of the body supported by the arms with the hands gripping the pommels, as illustrated in FIG. 1. The supporting structure 1, while providing adequate support for the legs and lower portion of the body of the user, elevating the same above the floor surface, at the same time provides substantially complete unlimited freedom of movement of the legs over the floor surface and, due to the novel belt construction, enables the legs to pivot relative to the structure 1 with any pivotal movement of the legs tending to move the belt 6 about the rollers 7, whereby the belt offers substantially no resistance to such pivotal movement.

As schematically illustrated in FIG. 2, the user, while supported from the pommel structure, may readily swing his leg and body in a circular motion, in which the pommel and user's arms generally form the pivot therefor. Thus, the user may readily swing his body from one side of the longitudinal axis of the pommel structure to the other, quite accurately simulating a vaulting or swinging movement corresponding to the vaulting or swinging movement of a gymnast from one side to the other of a pommel horse. As there is no danger of the user falling and injuring himself, the desired movements may be readily practiced whereby the user may perfect his techniques, improve muscular development and strength in the specific type of movements involved, and gain confidence in his ability prior to exercises on an actual pommel horse.

The leg-supportable structure

Referring to FIGS. 3 and 4 which illustrate details of the leg-supportable structure 1, the base member 3 may be constructed from any suitable material as for example a sheet of wood, metal, or the like, and is provided with four symmetrically disposed caster assemblies 13, each comprising a base plate 14 adapted to be rigidly mounted on the member 3 by suitable means, such as screws 15 which, for example, may be threaded into the base plate 14. Pivotally supported by the base plate 14, for movement about a vertical axis, is a wheel supporting castering yoke 16, in which is pivotally supported the cooperable wheel 4. Preferably, suitable ball or other bearing structure is disposed between the base plate 14 and the yoke 16 and suitable bearings may be provided on the wheels 4 to insure free movement of the wheels, both about their own axis and about the vertical axis of the yoke 16. The caster assemblies 14 may be of standard construction and the specific details thereof form no part of the present invention.

As previously described, the U-shaped member 5, which may be also formed from tubular metal stock or the like, is mounted on the base member 3 for pivotal movement about a vertical axis 17, again preferably supported by a suitable bearing assembly, indicated generally by the numeral 18, and, in the embodiment illustrated, comprises a lower bearing race plate 19 and an upper bearing race plate 20, which are provided with opposing circular race ways 21 and 22, respectively, in which are disposed a plurality of ball bearings 23, illustrated as being maintained in circumferentially spaced relation relative to the race ways 21 and 22 by a ball retainer ring 24 extending between the two race plates 19 and 20. As illustrated in FIG. 3, the race plates 19, 20, balls 23 and retainer 24 are maintained in assembled relation by a suitable pin 25 which prevents separation of the respective elements but permits free relative rotation of the respective race plates.

Rigidly mounted, by welding or other suitable means, to the upper plate 20 is a tubular support 26. As previously mentioned, the cradle member 5 may be of tubular metal stock and, in the embodiment of the invention illustrated, has its horizontal portion 27 extending through cooperable openings in the mounting member 26 with the portion 27 being rigidly attached to the member 26 and to the reinforcing ring 28 of the plate 20 by suitable means such as welding 26' and 28' or the like. The respective upper ends of the vertically disposed leg portions 28 of the U-shaped member 5 are provided with generally U-shaped brackets 29, illustrated as being formed out of strip or bar stock, having respective leg portions 30 connected at their ends adjacent the associated upright 28 by an intermediate portion 31 which, in the embodiment illustrated, is disposed in complemental slots in the free ends of the uprights and rigidly welded or otherwise attached thereto. The leg portions 30 of the brackets 29 are proportioned to receive therebetween the respective rollers 7, which are supported therefrom by respective threaded pivot shafts 32 or the like, the rollers 7 preferably also being provided with suitable bearing members 33, the details of which are not illustrated but which may be in the form of suitable ball or roller bearings, of standard construction, to insure free rotation of the respective rollers with a minimum of frictional resistance. Thus, when the user's legs are supported by the cradle formed by the lower portion 8 of the belt 6, upon pivotal movement of the user's legs, the belt is free to move with the legs, which thus function somewhat similar to a roller, causing the belt to move longitudinally, following the periphery of the user's legs, and thus offering no resistance to such pivotal movement. As a result of such construction, support is provided for the user's legs without any material impedance or restriction of the leg movement.

FIGS. 5 and 6 illustrate a modified embodiment of the invention, which eliminates the central pivot of the construction illustrated in FIGS. 1, 3 and 4, with corresponding pivotal movement being derived through the casters instead of through the additional central pivot.

In this construction two horizontally extended parallel base bars 3' are provided, formed from suitable stock, preferably lightweight sheet metal of sufficient strength. At the ends thereof are mounted respective caster assemblies 13, with the two base members 3' being connected by a belt-supporting assembly 5' corresponding to the member 5, and comprising a pair of inverted U-shaped members, indicated generally by the reference numeral 35, each of which has a horizontally extending intermediate portion 36, which connects respective downwardly depending leg portions 37 having their lower ends rigidly secured to the base bars 3' by suitable means as for example welding suitable diagonally extending brace members 38 may be provided, which have their ends rigidly secured, by welding or other suitable means, to the base member 3' and the associated leg 37, to provide a very strong and rigid structure, which at the same time is of relatively lightweight.

Each of the U-shaped members 35 is provided with respective diagonally extending members 39, illustrated in the embodiment of FIGS. 5 and 6 as being formed from bar stock, and having their respective ends secured to the adjacent leg 38 and intermediate portion 36, with each pair of opposed bars 39 forming supporting means for the respective rollers 7 which may be of identical construction to those employed in the embodiment of FIGS. 1, 3 and 4, including suitable bearing members, etc., not illustrated.

It will be appreciated that the basic operation of the embodiment of FIGS. 5 and 6 is identical with that of the construction of FIGS. 1, 3 and 4, with the exception that all pivoting of the belt 6 and its supporting structure about a vertical pivotal axis is accomplished through the caster assemblies 13, whereby the latter not only serve to support the structure from the floor and enable movement of the structure over the floor surface, but also accommodate and pivotal movement of the belt and its supporting structure. As this also entails pivotal movement of the castering wheels about the vertical axis of the respective casters, the structure of FIGS. 5 and 6 will tend to offer somewhat greater resistance to pivotal movement of the structure simultaneously with travel movement over the floor surface. However, as a number of parts including the large pivot bearing are eliminated, the cost of this type of structure may be somewhat less than that of the initially described structure.

Operation

The general operation of the present invention has been briefly heretofore described. However, it is believed that a somewhat more detailed description of the movements involved is desirable.

The standard pommel horse employed in gymnastics comprises a generally cylindrical padded body which may be approximately 4 feet or more in length and of approximately 10 to 12 inches in diameter, which is supported by a suitable leg structure at a height, usually adjustable, of approximately 3 to 4 feet above the floor, thus somewhat resembling a horse, and may be provided with a pair of transversely extending pommels or handles which, may be detachable.

In operation, the user, standing on the floor, grasps a pommel in each hand and supporting his body from the pommels by means of his hands and arms vaults or swings his legs from one side of the horse, over the body thereof, to the other side. Established routines have evolved, some of which, for example, include a more or less continual swinging of the body about its vertical pivot, passing approximately through the user's neck, with the arms and hands being alternately shifted to permit such a continuous swinging motion of the body over the pommel.

As substantially all movement takes place with the body being supported through the arms and hands, from the pommels, with the body generally extending horizontally at a height of approximately 4 feet above the floor, strength is required in the supporting arms to accomplish the desired movements and at the same time the bulk of the movement is performed with the body otherwise unsupported and moving through space. It will be apparent that with such type of movement it is difficult for the beginner to make the desired movements without additional support by the instructor or other person and, of course, the fear of falling, etc. tends to inhibit free movement. It will also be appreciated that this type of elementary instruction may readily produce the opposite and undesired result of creating a dislike and corresponding lack of interest in this type of gymnastics, to the point of discouraging any further participation. This is particularly true where children are involved, for example between the ages of 10 to 15 years. However, with the present invention a youngster can be started at a relatively very early age, i.e. prior to high-school age, combining fun and enjoyment with the desired exercising and buildingup of an interest in the pommel horse. The present invention provides a safe way to introduce the muscles to work in most of the positions involved on the pommel horse and enables easy step by step progress.

The present invention is of particular application and advantage in school training, where a coach may have a comparatively large number of pupils, making it difficult to give individual instructions to all of such students. However, by use of a plurality of exercisers constructed in accordance with the present invention, a large number of pupils simultaneously may be given basic instructions and may safely practice without constant direct personal supervision and without any danger of injury.

For the more advanced gymnasts the present invention enables exercise and practice to keep in trim, substantially anywhere there is adequate floor space, and as the present invention is relatively small in size, it may be stored substantially anywhere including closets, etc. It will be particularly noted that in the more advanced exercises, as for example where a complete 360° circle movement is involved accompanied by shifting of the hands on the pommels when the body passes over the same, the body will have simultaneously gone through pivotal or rotational movement, bringing into play movement of the belt 6 and rotation thereby of the rollers 7 to freely permit such body movement.

Having thus described my invention it will be obvious that although various minor modifications might be suggested by those versed in the art, it should be understood that I wish to embody within the scope of the patent granted hereon all such modifications as resonably, and properly come within the scope of my contribution to the art.

I claim as my invention:

1. An athletic training and exercising device, particularly for the pommel horse, adapted to support a user's legs while manipulating the body relative to a set of pommels, comprising a leg-supporting structrue having a generally inverted U-shaped configuration, said structure having leg-engaging means adapted to receive and support the lower leg portions of such a user for relatively free, unrestricted pivotal movement thereof, said U-shaped structure being in the form of two like inverted U-shaped members, respectively disposed in spaced parallel vertical planes, a pair of elongated base members disposed in spaced parallel relation at right angles to the planes of said U-shaped members, and each connecting the lower, free ends of corresponding legs thereof, floor-engaging means carried by said elongated base members for supporting said structure from such a floor surface for relatively free, unrestricted lateral pivotal movement with respect to the vertical, said leg-engaging means being disposed between said inverted leg portions and comprising a leg-engaging endless belt supported by a pair of laterally spaced supporting rollers, carried by said U-shaped members, which belt forms a cradle upon which such a user's legs may rest, with said belt being relatively freely movable on said spaced supporting members relative to said U-shaped members in a lateral direction transverse to such a user's body axis.

2. An athletic training and exercising device according to claim 1, comprising in further combination, a pommel structure having a pair of pommels and means for supporting the same from a floor surface in a relatively stationary position, with the pommels disposed adjacent such surface, said pommels and said leg-engaging means beng relatively so spaced above such a floor surface that the user's legs may be supported by said leg-engaging means in a substantially horizontal position when the user's body is supported from said pommels by the hands and arms.

3. An athletic training and exercising device, particularly for the pommel horse, comprising a pommel structure having a pair of pommels of generally arcuate shape and disposed in spaced parallel planes with the ends of the pommels extending downwardly, said supporting means of said pommel structure comprising a pair of spaced parallel elongated members extending at right angles to said planes with said pommels having their corresponding ends rigidly connected to said members, said members terminate at their free ends in respective caps forming non-slip floor engaging members operative to frictionally engage such a supporting floor surface and maintain the pommel structure stationary relative thereto during use of the device, and means for supporting said pommels from a floor surface in a relatively stationary position, with the pommels disposed adjacent such surface, and a leg-supportable structure for such a user's legs physically independent of said pommels, means including floor-engaging means for supporting said structure from such a floor surface for relatively free, unrestricted lateral pivotal with respect to the vertical, said structure having leg-engageable means adapted to receive and support the lower leg portions of such a user thereof for relatively free, unrestricted pivotal movement thereof.

4. An athletic training and exercising device, particularly for the pommel horse, adapted to support a user's legs while manipulating the body relative to a set of pommels, comprising a leg-supporting structure means, including floor-engaging members, for supporting said structure from such a floor surface for relatively free, unrestricted lateral pivotal movement with respect to the vertical, said structure having cradle-shaped leg-engaging means, upon which the user's legs may rest, in the form of an endless belt supported by a pair of laterally spaced freely rotatable rollers carried by said cradle, said belt is relatively freely movable on said spaced supporting members relative to said vertical axis, in a lateral direction transverse to such a user's body axis, and is thus adapted to receive and support the lower leg portions of such a user thereof for relatively free, unrestricted pivotal movement thereof.

5. An athletic training and exercising device according to claim 4, wherein said rollers having a concave belt-supporting surface.

6. An athletic training and exercising device, particularly for the pommel horse, adapted to support a user's legs while manipulating the body relative to a set of pommels, comprisng a leg-supporting structure having a generally inverted U-shaped configuration, said structure havng leg-engaging means adapted to receive and support the lower leg portions of such a user for relatively free, unrestricted pivotal movement thereof, said U-shaped structure being in the form of two like inverted U-shaped members, respectively disposed in spaced parallel vertical planes, a pair of elongated base members disposed in spaced parallel relation at right angles to the planes of said U-shaped members, and each connecting the free ends of corresponding legs thereof, floor-engaging means carried by said elongated base members for supporting said structure from such a floor surface for relatively free, unrestricted lateral pivotal movement with respect to the vertical, said leg-engaging means comprising a leg-engaging endless belt supported by a pair of laterally spaced supporting members, carried by said U-shaped members, which belt forms a cradle upon which such a user's legs may rest, with said belt being relatively freely movable on said spaced supporting members relative to said U-shaped members in a lateral direction transverse to such a user's body axis, and a pommel structure having a pair of pommels of generally arcuate shape and disposed in spaced parallel planes with the ends of the pommels extending downwardly, and means for supporting the same from a floor surface in a relatively stationary position, with the pommels disposed adjacent such surface, said supporting means of said pommel structure comprising a pair of spaced parallel elongated members extending at right angles to said planes with said pommels having their corresponding ends rigidly connected to said members, said pommels and said leg-engaging means being relatively so-spaced above such a floor surface that the user's legs may be supported by said leg-engaging means in a substantially horizontal position when the user's body is supported from said pommels by the hands and arms.

7. An athletic training and exercising device according to claim 6, wherein said pommel-supporting members terminate at their free ends in respective caps forming non-slip floor-engaging members operative to frictionally engage such a supporting floor surface and maintain the pommel structure stationary relative thereto during use of the device.

8. An athletic training and exercising device, particularly for the pommel horse, adapted to support a user's legs while manipulating the body relative to a set of pommels, comprising a leg-supporting structure having a generally inverted U-shaped configuration, said structure having leg-engaging means adapted to receive and support the lower leg portions of such a user for relatively free, unrestricted pivotal movement thereof, said U-shaped structure being in the form of two like inverted U-shaped members, respectively disposed in spaced parallel vertical planes, a pair of elongated base members disposed in spaced parallel relation at right angles to the planes of said U-shaped members, and each connecting the free ends of corresponding legs thereof, floor-engaging means carried by said elongated base members for supporting said structure from such a floor surface for relatively free, unrestricted lateral pivotal movement with respect to the vertical, said leg-engaging means comprising a leg-engaging endless belt supported by a pair of laterally spaced freely rotatable rollers carried by said U-shaped members, which belt forms a cradle upon which such a user's legs may rest, with said belt being relatively freely movable on said spaced supporting members relative to said U-shaped members in a lateral direction transverse to such a user's body axis.

9. An athletic training and exercising device according to claim 8, wherein said rollers having a concave belt-supporting surface.

10. An athletic training and exercising device, particularly for the pommel horse, adapted to support a user's legs while manipulating the body relative to a set of pommels comprising, a leg-supporting structure, a base member means for supporting said leg-supporting structure, said device having floor-engaging members for supporting said base member means from such a floor surface to permit relatively free, unrestricted lateral pivotal movement thereover with respect to a vertical axis, said floor-engaging members comprising a plurality of casters, each of which comprises a wheel and a supporting member therefor, each said supporting member being pivotally connected to said base member means for pivotal movement about a vertical axis, said structure having cradle-shaped leg-engaging means for supporting a user's legs, said cradle-shaped leg engaging means being supported by said base member means so as to permit relatively free unrestricted pivotal movement relative thereto about a vertical axis, said leg-engaging means including an endless belt supported by a pair of laterally spaced supporting members pivotally supported by said base member means, said base member means including a ball-bearing assembly, said belt is relatively freely movable on said spaced supporting members relative to a vertical axis, in a lateral direction transverse to such a user's body axis, and is adapted to receive and support the lower portions of a user's legs thereof for relatively free, unrestricted pivotal movement thereof.

11. An athletic training and exercising device, particularly for the pommel horse, adapted to support a user's legs while manipulating the body relative to a set of pommels, comprising a leg-supporting structure, including a base member means, floor-engaging members for supporting said base member means from such a floor surface so as to permit relatively free, unrestricted lateral pivotal movement thereover with respect to a vertical axis, said structure having cradle-shaped leg-engaging means for supporting a user's legs, said device being supported by said base member means for relatively free unrestricted pivotal movement relative thereto about a vertical axis, said leg-engaging means including an endless belt supported by a pair of laterally spaced supporting members pivotally supported by said base member means by a ball bearing assembly, said belt being relatively freely movable on said spaced supporting members relative to a vertical axis, in a lateral direction transverse to such a user's body axis, and is adapted to receive and support the lower leg portions of such a user thereof for relatively free, unrestricted pivotal movement thereof.

* * * * *